US011111765B2

(12) United States Patent
Al-Mulhem et al.

(10) Patent No.: US 11,111,765 B2
(45) Date of Patent: Sep. 7, 2021

(54) WELL LIVENING TOOL BASED ON NITROGEN PRODUCING CHEMISTRY

(71) Applicant: Saudi Arabian Oil Company, Dhahran (SA)

(72) Inventors: Abdulrahman Abdulaziz Al-Mulhem, Dhahran (SA); Mohammed Abdullah Bataweel, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 735 days.

(21) Appl. No.: 15/953,851

(22) Filed: Apr. 16, 2018

(65) Prior Publication Data

US 2019/0316450 A1 Oct. 17, 2019

(51) Int. Cl.

| | |
|---|---|
| ***E21B 43/12*** | (2006.01) |
| ***C06D 5/06*** | (2006.01) |
| ***E21B 43/243*** | (2006.01) |
| ***E21B 47/00*** | (2012.01) |

(52) U.S. Cl.

CPC ..... *E21B 43/122* (2013.01); *C06D 5/06* (2013.01); *E21B 43/243* (2013.01); *E21B 47/00* (2013.01)

(58) Field of Classification Search

CPC ..... E21B 43/122; E21B 43/243; E21B 47/00; E21B 43/248; E21B 43/263; C06D 5/06

See application file for complete search history.

(56) References Cited

U.S. PATENT DOCUMENTS

| | | | | |
|---|---|---|---|---|
| 1,663,311 A | | 3/1928 | Miles | |
| 3,100,525 A | | 8/1963 | Smith et al. | |
| 4,823,875 A | * | 4/1989 | Hill | E21B 43/263 166/280.1 |
| 5,186,491 A | * | 2/1993 | Yoshida | B60R 21/2644 280/741 |
| 5,403,036 A | | 4/1995 | Zakula et al. | |
| 5,429,191 A | * | 7/1995 | Schmidt | E21B 43/26 166/297 |

(Continued)

FOREIGN PATENT DOCUMENTS

| | | |
|---|---|---|
| CA | 2501448 A1 | 5/1995 |
| CN | 106368634 A | 2/2017 |

(Continued)

OTHER PUBLICATIONS

International Search Report and Written Opinion for related PCT application PCT/US2019/027530 dated Jul. 17, 2019.

*Primary Examiner* — Christopher J Sebesta
(74) *Attorney, Agent, or Firm* — Bracewell LLP; Constance G. Rhebergen; Brian H. Tompkins

(57) ABSTRACT

A well livening downhole tool for the in-situ production of nitrogen is provided. The well livening downhole tool may produce nitrogen in-situ in a well to lighten the fluid column and lift the well fluids. The well livening downhole tool may include sodium azide and other reactants to produce nitrogen and scavenge other reaction products to produce alkaline silicate and water. The well-livening downhole tool may include multiple modules each having nitrogen-producing reactants and ignition components such that each module may be activated independently to produce nitrogen at different depths. A process for lifting the well fluids using the well livening downhole tool is also provided.

9 Claims, 2 Drawing Sheets

(56) References Cited

U.S. PATENT DOCUMENTS

| | | | | |
|---|---|---|---|---|
| 5,564,861 | A * | 10/1996 | Khudenko | B09C 1/00 405/128.65 |
| 6,966,373 | B2 | 11/2005 | Von Gynz-Rekowski | |
| 8,973,657 | B2 | 3/2015 | Miller et al. | |
| 9,441,451 | B2 | 9/2016 | Jurgensmeier | |
| 9,580,976 | B1 * | 2/2017 | Grubelich | E21B 17/1014 |
| 2002/0162662 | A1 | 11/2002 | Passamaneck et al. | |
| 2009/0283260 | A1 * | 11/2009 | Surjaatmadja | E21B 43/263 166/250.1 |
| 2013/0126175 | A1 | 5/2013 | Al-Mulhem et al. | |
| 2015/0034339 | A1 * | 2/2015 | Jurgensmeier | E21B 33/134 166/387 |
| 2017/0198562 | A1 * | 7/2017 | Walters | E21B 43/295 |

FOREIGN PATENT DOCUMENTS

| | | | | |
|---|---|---|---|---|
| RU | 2147337 | * | 4/2000 | E21B 43/16 |
| RU | 2147337 C1 | | 4/2000 | |
| RU | 2194852 C1 | | 12/2002 | |

* cited by examiner

WELL LIVENING TOOL BASED ON NITROGEN PRODUCING CHEMISTRY

BACKGROUND

Field of the Disclosure

Embodiments of the disclosure generally relate to an oil recovery process and enhancing oil recovery from a reservoir formation. In particular, embodiments of the disclosure relate to livening a well using in-situ nitrogen production.

Description of the Related Art

The search for and recovery of oil is becoming increasingly difficult as world-wide petroleum reserves decline. The use of improved oil recovery (also referred to as enhanced oil recovery (EOR)) processes increase the production of hydrocarbon bearing wells and fields. The EOR processes used in modern oil and gas operations may include chemical, gas, thermal, and microbial based processes. Oil or gas wells may be treated by injection of fluids for various operations, such as acids injected for stimulation and formation damage clean up, or brines injected during well completions. After treatment with various fluids, a well may no longer have sufficient reservoir pressure to push the accumulated fluids in the wellbore to eliminate the fluids and continuation production of hydrocarbons.

SUMMARY

Embodiments of the disclosure include a well livening downhole tool for the in-situ production of nitrogen to lighten the fluid column in a well and lift the well fluids.

In one embodiment, a method for increasing production of fluids from a well having a wellbore extending into a formation having a hydrocarbon reservoir is provided. The method includes inserting a tool into the wellbore. The tool includes a body defining an interior chamber such that the interior chamber contains a plurality of reactants, such that the plurality of reactants include sodium azide. The tool also includes an ignition component connected to a wireline, the ignition component including an igniter. The method further includes initiating reaction of the sodium azide to produce nitrogen in-situ in the well.

In some embodiments, initiating reaction of the sodium azide includes sending an electrical signal from the surface to the ignition component to generate heat and ignite the igniter. In some embodiments, the plurality of reactants include potassium nitrate and silicon dioxide. In some embodiments, the in-situ production of nitrogen results in the in-situ production of alkaline silicate. In some embodiments, the ignition component includes a bridgewire. In some embodiments, the igniter includes boron-potassium nitride. In some embodiments, the body is a first body and the ignition component is a first ignition component, such that the tool includes a first module having the first body and the first ignition component. In such embodiments, the tool includes a second body defining a second interior chamber, the second interior chamber containing a second plurality of reactants, the second plurality of reactants including sodium azide, and second ignition component connected to the wireline, the second ignition component including a second igniter. In some embodiments, the first module and the second module are located at different depths in the wellbore. In some embodiments, the method includes determining a depth in the wellbore for the in-situ production of nitrogen and determining that the second module is nearest the depth.

In another embodiment, a downhole tool for the in-situ production of nitrogen in a well is provided. The tool includes a body defining an interior chamber, the interior chamber containing a plurality of reactants, such that the plurality of reactants include sodium azide. The tool further includes an ignition component configured to be connected to a wireline, the ignition component including an igniter. In some embodiments, the tool includes the plurality of reactants include potassium nitrate and silicon dioxide. In some embodiments, the ignition component includes a bridgewire. In some embodiments, the igniter includes boron-potassium nitride. In some embodiments, the body is a first body and the ignition component is a first ignition component, such that the tool includes a first module that includes the first body and the first ignition component. In such embodiments, the tool includes a second body defining a second interior chamber, the second interior chamber containing a second plurality of reactants, the second plurality of reactants including sodium azide, and a second ignition component configured to be connected to the wireline, the second ignition component including a second igniter. In some embodiments, the plurality of reactants at least partially surround the ignition component.

In another embodiment, a downhole tool for the in-situ production of nitrogen in a well. The tool includes a first module located at a first position along a wireline. The first module includes a first body defining a first interior chamber, the first interior chamber containing a first plurality of reactants, the first plurality of reactants including sodium azide, and a first ignition component configured to be connected to the wireline, the first ignition component including a first igniter. The tool also includes a second module located at a second position along the wireline. The second module includes a second body defining a second interior chamber, the second interior chamber containing a second plurality of reactants, the second plurality of reactants including sodium azide, and a second ignition component configured to be connected to the wireline, the second ignition component including a second igniter, such that the first module and the second module are independently activated to produce nitrogen via an electrical signal provided on the wireline. In some embodiments, the first plurality of reactants include potassium nitrate and silicon dioxide and the second plurality of reactants include potassium nitrate and silicon dioxide. In some embodiments, the first plurality of reactants of the first module are selected to produce a first volume of nitrogen and the second plurality of reactants of the second module are selected to produce a second volume of nitrogen. In some embodiments, the first igniter includes boron-potassium nitride and the second igniter includes boron-potassium nitride.

DETAILED DESCRIPTION

The present disclosure will be described more fully with reference to the accompanying drawings, which illustrate embodiments of the disclosure. This disclosure may, however, be embodied in many different forms and should not be construed as limited to the illustrated embodiments. Rather, these embodiments are provided so that this disclosure will be thorough and complete, and will fully convey the scope of the disclosure to those skilled in the art.

Embodiments of the disclosure include a well livening downhole tool for the in-situ production of nitrogen to lighten the fluid column in a well and thus lift the well fluids. The well livening downhole tool may include sodium azide and other reactants to produce nitrogen and scavenge other reaction products to produce alkaline silicate and water. Embodiments of the well livening downhole tool may include an ignition component to initiate the nitrogen-producing reaction. Some embodiments of the well-livening downhole tool may include multiple modules each having nitrogen-producing reactants and ignition components such that each module may be activated independently to produce nitrogen at different depths.

Figure 1:
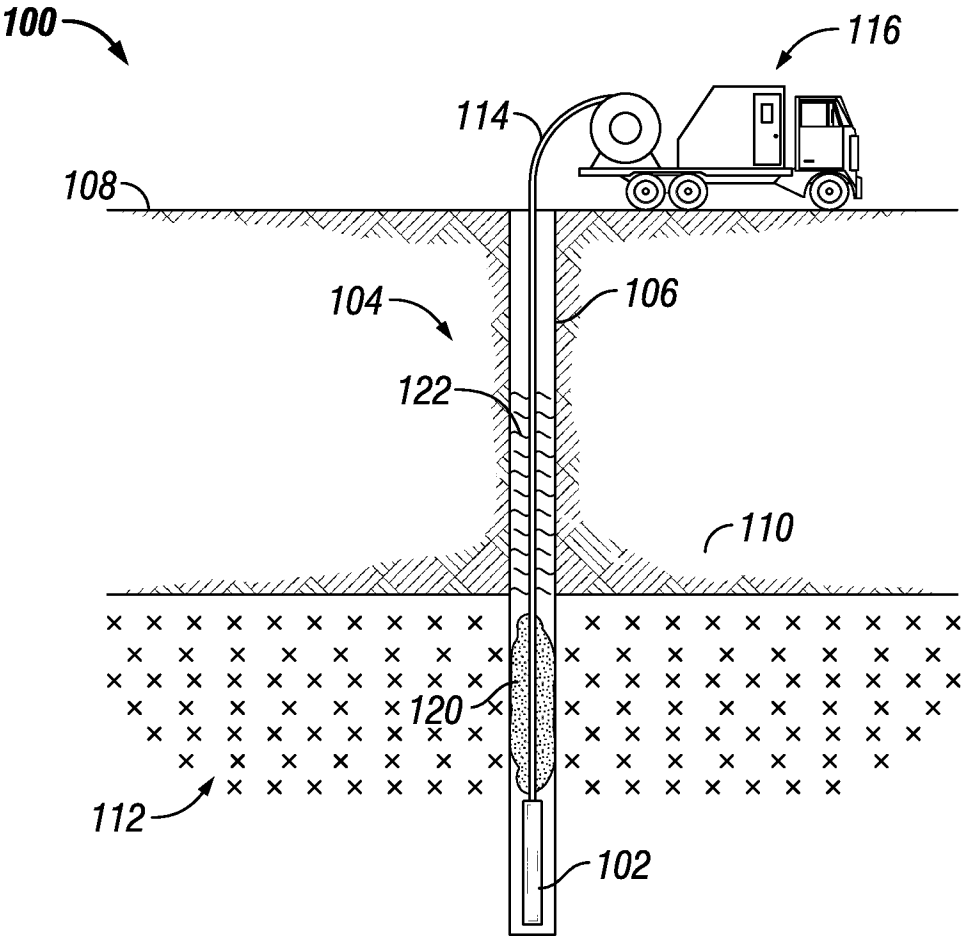
FIG. 1 is a schematic diagram of a well site illustrating operation of a well livening downhole tool for the in-situ production of nitrogen in accordance with an embodiment of the disclosure.

Advantageously, as compared to propellant-based well lifting techniques, the well livening downhole tool described in the disclosure enables the in-situ production of nitrogen downhole without the significant heat generation and potential hazards of propellants. Additionally, the well livening downhole tool described in the disclosure may have reduced cost and complexity as compared to conventional well lift techniques that use a truck with a gas container that pumps gas downhole using coiled tubing FIG. 1 depicts a well site 100 illustrating operation of a well livening downhole tool 102 for the in-situ production of nitrogen in accordance with an embodiment of the disclosure. In the illustrated embodiment, the well livening downhole tool 102 is inserted in a well 104 defining a wellbore 106 extending from the surface 108. The wellbore 106 extends into a formation 110 having a hydrocarbon reservoir 112. The wellbore 106 may be, for example, a wellbore of a production well in various stages of production. The wellbore 106 may be a cased wellbore. The wellbore 106 may include any form of a hole formed in a geologic formation for the purpose of extracting hydrocarbons or other resources from the reservoir 112.

In some embodiments, the well livening downhole tool 102 may be a wireline tool suspended on a wireline 114. The wireline 114 may include a conductor and may enable data transmission of electrical signals to the wireline tool 102 from a wireline monitoring and control system (for example, a wireline truck 116 having various components of a wireline system, as shown in FIG. 1). For example, an electrical signal may be transmitted to the well livening downhole tool 102 to control operation of the tool 102, such as initiating an ignition element to facilitate the in-situ production of nitrogen in the wellbore 106. The wireline 114 may be raised and lowered within the well 104 to various depths using devices known in the art, such as a reel and drum apparatus in the wireline truck 116 having the various components of a wireline system. The wireline truck 116 or other onsite system may facilitate operation of the well livening downhole tool 102 in the wellbore 106.

Although the embodiment shown in FIG. 1 depicts a wireline tool, in other embodiments, the well livening downhole tool 102 may be adapted for use as other suitable tools for insertion in to the wellbore 106. In other embodiments, the well livening downhole tool 102 may be deployed in other manners, such as by a slickline or coiled tubing.

The well 102 may undergo various operations known in the art to assist in production of hydrocarbons from the reservoir 112, such as acid treatment, or waterflooding. In such instances, fluids in the wellbore may have insufficient pressure to enable continued production. As shown in FIG. 1 and as described in the disclosure, the well livening downhole tool 102 may provide for the in-situ production of nitrogen to increase the pressure of fluids in the wellbore 106 and enable continued production of hydrocarbons from the well 102. The well livening downhole tool 102 may be operated via an electrical signal from the wireline truck 116 to generate a nitrogen 120 from the tool 102. As shown by the simplified schematic in FIG. 1, the nitrogen 120 may exit an opening in the well livening downhole tool 102 into the wellbore 106. The release of the nitrogen 120 may lighten the fluid column in the wellbore 106 and enable removal of the fluids from the wellbore 106, as shown in FIG. 1 by the lifted fluids 122 in the wellbore 106.

After lifting the fluids 122, various fluids may be removed from the wellbore 106. For example, acids, brines, treatment fluids, and the like used in operations on the well 102 may be removed after lifting the fluids 122 via the in-situ production of nitrogen. The removal of such fluids may enable the continued production of hydrocarbons from the reservoir 112 via the well 102.

The in-situ production of nitrogen and subsequent reactions with other products may be performed according to the chemical formulas described supra. Nitrogen may be produced from sodium azide as per chemical Equation 1:

$$2NaN_3 \rightarrow 2Na + 3N_2 \quad (1)$$

The reaction may be initiated using an ignition component and an igniter that initiates the reaction. For example, an ignition component may include an electrical component (for example, a bridgewire) for generating heat and an igniter such as boron-potassium nitride (BPN).

The sodium produced from sodium azide according to Equation 1 may be reacted with potassium nitrate to scavenge the produced sodium and produce more nitrogen. Potassium nitrate may react with the sodium produced from the sodium azide to produce more nitrogen per chemical Equation 2:

$$10Na + 2KNO_3 \rightarrow K_2O + 5Na_2O + N_2 \quad (2)$$

The potassium oxide ($K_2O$) and sodium oxide ($5Na_2O$) may react with silicon dioxide ($SiO_2$) to form, for example, a stable alkaline silicate (that is, glass). Examples of such reactions are shown in chemical Equations 3, 4, and 5:

$$K_2O + SiO_2 \rightarrow K_2SiO_3 \quad (3)$$

$$2Na_2O + SiO_2 \rightarrow Na_4SiO_4 \quad (4)$$

$$Na_2O + SiO_2 \rightarrow Na_2SiO_3 \quad (5)$$

The formation of the stable alkaline silicate removes potentially reactive products and may be easily removed from the well.

Embodiments of the disclosure may include determining the amount of nitrogen for lifting the fluids in a well. The amount of reactants for a downhole well livening tool used in a well may be determined according to the techniques described in the following paragraphs.

Initially, the pressure ($P_{well}$) in the well may be determined according to Equation 6:

$$P_{well}=G\times\text{TVD} \tag{6}$$

Where TVD is the true vertical depth (in feet (ft)) and G is the fluid gradient in the well (that is, the weight of the fluid in the well) expressed in pounds-per-square inch per foot (psi/ft). In some embodiments, water may be the base for the fluids in the well such that G is equal to 0.433 psi/ft.

As will be appreciated, when a well does not flow, the pressure in the reservoir is less than the weight of the fluids. To liven the well and restore fluid flow, the volume of nitrogen introduced downhole should be sufficient to fill the entire wellbore to replace the fluid column. This volume of nitrogen ($V_{N2}$) may be determined according to Equation 7:

$$V_{N2}=\text{TVD}\times\text{well cross-sectional area} \tag{7}$$

Where the well cross-sectional area may be determined by $\pi r^2$ where r is the radius of the well.

The amount of nitrogen-producing reactants for producing the volume of nitrogen ($V_{N2}$) for lifting the well fluids may be predicted from Equations 1-3. To ensure that the nitrogen-producing reactants are combined such that no excess reactants remain after the production of nitrogen, the moles of the reactants may be balanced according to the Equation 8:

$$\begin{array}{ccccccccc} 10NaN_3 & \longrightarrow & 10Na & + & 15N_2 & & & & \\ & & \downarrow & & & & & & \\ & & 10Na & + & 2KNO_3 & \longrightarrow & K_20 & + & 5Na_20 + N_2 \end{array} \tag{8}$$

As shown in Equation 8, 10 moles of sodium azide ($NaN_3$) and 2 moles of potassium nitrate ($KNO_3$) will produce 16 moles of nitrogen.

By assuming that the nitrogen gradient in the well is negligible in comparison to the weight of the well fluids and using the atomic weights of the elements involved in the reaction, the simple gas equation shown in Equation 9 may be used to determine the amount of reactants to produce the amount nitrogen for lifting the well fluids:

$$P_1V_1=P_2V_2 \tag{9}$$

Where $V_1$ is the volume of nitrogen produced from the reactants, $P_1$ is the initial pressure on the produced amount of nitrogen when the reaction is triggered, $V_2$ is the amount of nitrogen for lifting the well fluids ($V_{N2}$ determined according to Equation 7), $P_2$ is the final pressure after nitrogen expansion pushing the fluids out of the hole. The pressure $P_1$ is the weight of the fluids filling the wellbore and preventing fluid flow from the well. Thus, according to Equation 6, the pressure $P_1$ may be TVD×0.433 psi/ft. The pressure $P_2$ may be atmospheric pressure if the well is open to a flare pit or the trunk line pressure if the well is open to the production gathering system. For the calculation described in this example, $P_2$ is assumed to be atmospheric pressure of 14.7 psi.

Using Equations 4 and 5 and the values for $P_2$ and G assumed in this example, Equation 9 may be expressed as Equation 10:

$$V_1=\frac{P_2V_2}{P_1}=\frac{14.7\times TVD\times\pi r^2}{TVD\times 0.433}=\frac{14.7\times\pi r^2}{0.433}=106.6\,r^2 \tag{10}$$

Accordingly, for an example well with a 4 inch diameter, r=2 inches=2/12 ft=0.167 ft. Accordingly, for a 4 inch diameter well, the volume of nitrogen to be produced by the reactants may be determined according to Equation 11:

$$V_1=106.6r^2=106.6*0.167^2=2.96\ \text{ft}^3 \tag{11}$$

As will be appreciated, this volume is subsequently produced at the pressure in the bottom of the well. For example, at a well depth of about 10000 ft the pressure may be about 4300 psi.

Using this volume of nitrogen the moles of nitrogen to be produced may be determined and the amount (for example, moles) of reactants such as sodium azide, potassium nitrate, and silicon dioxide may be determined using Equations 1-3. For example, assuming a molar volume of 22.4 moles/liter (L) at standard temperature and pressure (STP), 2.96 $ft^3$ of nitrogen is about 3.7 moles of nitrogen. According to Equation 1, 2.5 moles of sodium azide would be used to produce 3.7 moles of nitrogen. In this manner, the amounts of the reactants used in the well livening downhole tool may be determined to produce am amount of nitrogen for lifting the well fluids.

Figure 2:
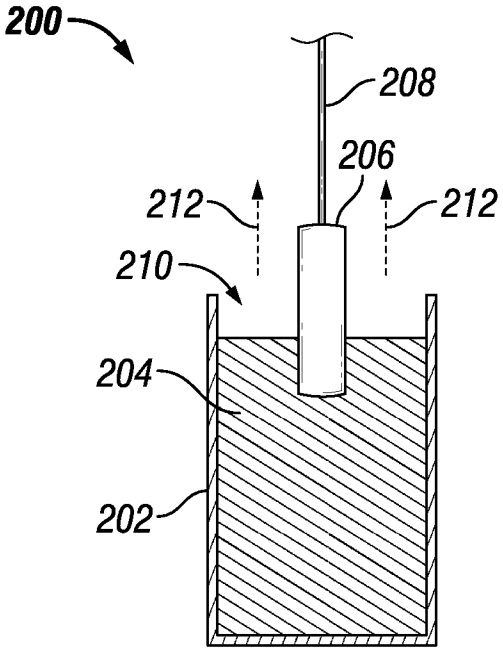
FIG. 2 is a schematic diagram of an example well livening downhole tool in accordance with an embodiment of the disclosure.

FIG. 2 depicts an example well livening downhole tool 200 in accordance with an embodiment of the disclosure. In some embodiments, the depicted well livening downhole tool 200 may represent a section of a tool, such that some embodiments of the tool may include multiple sections having the components depicted in FIG. 2. The well livening downhole tool 200 includes a body 202 containing reactants 204 and an ignition component 206. In some embodiments, the ignition component 206 may be connected to a wireline 208. The reactants 204 may partially or fully surround the ignition component 206

Upon activation of the well livening downhole tool 200, one or more of the reactants 204 may generate nitrogen according to known chemical reactions. For example, the reactants 204 may include sodium azide. In some embodiments, the reactants 204 may include additional reactants to produce additional nitrogen and scavenge other products. In such embodiments, the reactants 204 may include potassium nitrate and silicon dioxide to react with other products and produce alkaline silicate glass. In some embodiments, after reaction of the reactants 204 and production of nitrogen, the alkaline silicate glass may be contained in the body 202 and may be retrieved from the well for disposal by removing the tool 200.

The ignition component 206 may include a heat-generating device and an igniter that ignites upon contact with heat or a spark. In some embodiments, the ignition component 206 may include a bridgewire to generate heat and boron-potassium nitrate (BPN) that ignites in response to the generated heat.

In some embodiments, the body 202 may be generally cylindrical-shaped. The body 202 of the tool may form an enclosed space for containing the reactants 204 and may define an end 210 that defines the exit path (shown by arrows 212) for the generated nitrogen. In some embodiments, the body 202 may define an opening at one end of the body 202, such that the generated nitrogen may exit the body 202 through the opening. In some embodiments, a removable or breakable cap may be disposed over the end 210 of the body 202 of the tool 200, such that the cap breaks apart or is removed in response to the pressure of the generated nitrogen. As will be appreciated, the dimensions (for example, diameter) of the body 202 may be selected to ensure that the body 202 fits downhole.

Figure 3:
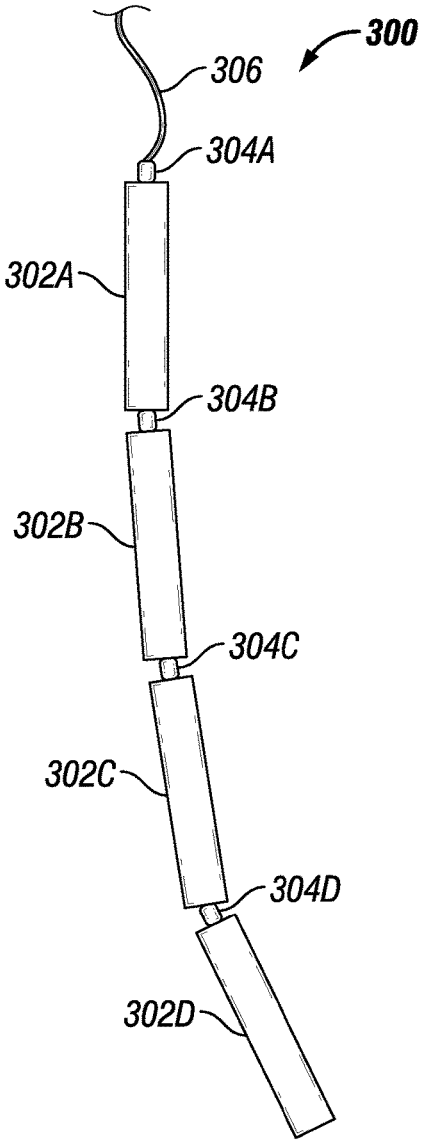
FIG. 3 is a schematic diagram of an example well livening downhole tool having multiple modules in accordance with an embodiment of the disclosure.

In some embodiments, a well livening downhole tool may include multiple modules that may each be independently triggered to generate nitrogen at different depths. FIG. 3 depicts an embodiment of a well livening downhole tool 300 having multiple modules 302 in accordance with an embodiment of the disclosure. Each module 302 may include an independent ignition component 304 such that nitrogen may be produced from one module without activating the other modules. The well livening downhole tool 300 may be connected to a wireline 306. In such embodiments, the wireline 306 may extend through or around each module 302 to connect to the ignition component 304 of the next module 302 of the tool 300. Each module 302 may contain reactants for the in-situ production of nitrogen downhole. In some embodiments, each module 302 may have similar design and components as the module 200 illustrated in FIG. 2 and described supra.

The different modules 302 of the well livening downhole tool 300 may enable the in-situ production of nitrogen at different depths. For example, the nitrogen may be generated at a first depth using module 302D (that is, by sending an electrical signal from the surface to ignition component 304D). In another example, the nitrogen may be generated at a second depth using module 302B (that is, by sending an electrical signal from the surface to ignition component 304B). In some embodiments, each module 302 may be coupled to different electrical conductor that may be identified at the surface using an identifier. For example, each conductor may terminate in a switch or other device at the surface that identifies a number of the modules, a depth of the module along the wireline, or other identification. In some embodiments, each module or electrical connection thereto may include an identifier such that an electrical signal from a wireline control system at the surface may be routed to an appropriate igniter based upon selections from an operator or other actions.

Additionally, the different modules 302 of the well livening downhole tool 300 may enable the production of different amounts (for example, volumes) of nitrogen. For example, the module 302A may have an amount of reactants that produces a first volume of nitrogen, and the module 302B may have a different amount of reactants that produces a second volume of nitrogen.

In some embodiments, the tool 300 may be configurable by adding or removing modules 302 to shorten or lengthen the tool 300. The number of modules 302 may be based on well conditions, well depth, and so on. For example, the length of the tool 300 may be increased by adding modules 302 for the generation of nitrogen at greater depths. The modules 302 may be added by extending and connecting the wireline 306 to the ignition component 302 of a module 302. In some embodiments, after insertion in a well, nitrogen may be produced using multiple modules 302 of the well livening downhole tool 300, such that each successive in-situ production of nitrogen further lightens the fluid column and lifts the well fluids. For example, nitrogen may be produced from module 302D, followed by production of nitrogen from the module 302C, and so on.

Figure 4:
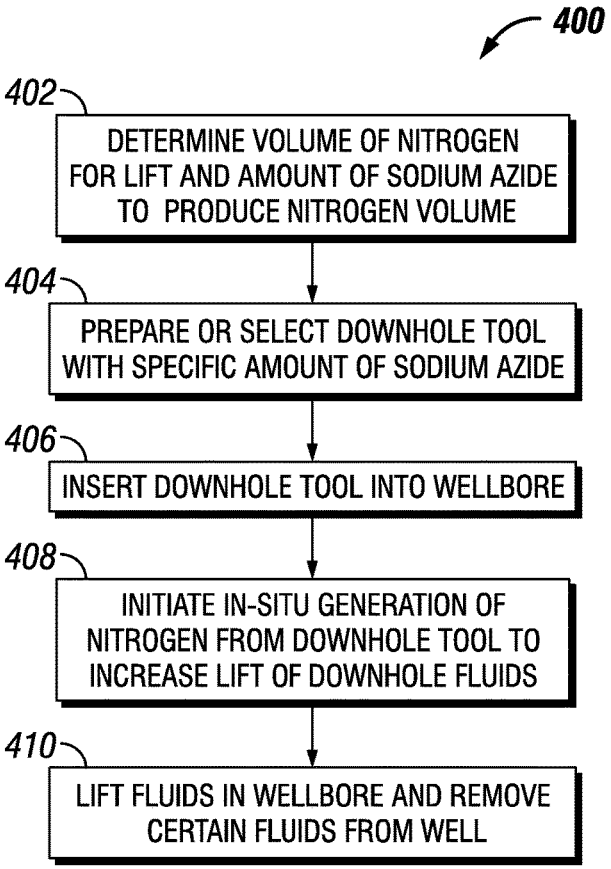
FIG. 4 is a block diagram of a process for livening a well using a well livening downhole tool for the in-situ production of nitrogen in accordance with an embodiment of the disclosure.

FIG. 4 depicts a process 400 for livening a well using a well livening downhole tool for the in-situ production of nitrogen in accordance with an embodiment of the disclosure. In some embodiments, the volume of nitrogen for lifting the well fluids and the amount of sodium azide to produce the nitrogen volume may be determined (block 402), using Equations 1-8 and the techniques described supra. A well livening downhole tool with the determined amount of sodium azide and other reactants may be prepared or selected (block 404). For example, in some embodiment a well livening tool may include a number of modules having varying amounts of sodium azide. In such embodiments, the module having the amount of sodium azide closest to the determined amount may be selected. In some embodiments, preparation or selection of a well livening downhole tool may include preparing or selecting a tool with a specific number of modules. As discussed supra, the number of modules of a well livening downhole tool may be selected based on the well depth or other parameters.

Next the well livening downhole tool may be inserted into a wellbore (block 406). For example, as discussed supra, in some embodiments the well livening downhole tool may be wireline tool that may be inserted into a wellbore using a reel and drum or other known mechanisms for wireline operation. Next, the in-situ production of nitrogen may be initiated at a specific depth to release nitrogen into the well and lighten the fluid column in the well (block 408). For example, in some embodiments an electrical signal may be sent over a wireline to an ignition component of a specific module located at a specific depth in the wellbore. For example, the electrical signal may activate a bridge wire that produces heat and ignites an igniter in the ignition component.

As discussed in the disclosure, lightening of the fluid column by in-situ produced nitrogen lifts the fluids in the well and enables the removal of certain fluids from the well (block 410). For example, the lightened fluid column may enable the removal of treatment fluids, injection fluids, or other fluids used in the well that may have altered the fluid column and reduced lift so that production of reservoir fluids was difficult or impractical. After removal of certain fluids from the well, production of hydrocarbons from the well may be restarted. In some embodiments, multiple in-situ productions of nitrogen may be used to lift the well fluids. For example, nitrogen may be produced using multiple modules of a well livening tool, such that each successive in-situ production of nitrogen further lightens the fluid column and lifts the well fluids.

Ranges may be expressed in the disclosure as from about one particular value, to about another particular value, or both. When such a range is expressed, it is to be understood that another embodiment is from the one particular value, to the other particular value, or both, along with all combinations within said range.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used described in the disclosure are for organizational purposes only and are not meant to be used to limit the scope of the description.

What is claimed is:

1. A method for increasing production of fluids from a well having a wellbore extending into a formation having a hydrocarbon reservoir, the method comprising:

inserting a tool into the wellbore, the tool comprising:

a body defining an interior chamber, the interior chamber containing a plurality of reactants, the plurality of reactants comprising sodium azide;

an ignition component connected to a wireline, the ignition component comprising an igniter;

initiating reaction of the sodium azide to produce nitrogen in-situ in the well, wherein the volume of produced nitrogen is proportional to a true vertical depth and a cross-sectional area of the well, and comprises an amount sufficient to fill the wellbore; and releasing the nitrogen from the interior chamber into the wellbore to lighten the fluid column in the wellbore and lift fluids in the wellbore.

2. The method of claim 1, wherein initiating reaction of the sodium azide comprises sending an electrical signal from the surface to the ignition component to generate heat and ignite the igniter.

3. The method of claim 1, wherein the plurality of reactants comprise potassium nitrate and silicon dioxide.

4. The method of claim 3, wherein the in-situ production of nitrogen results in the in-situ production of alkaline silicate.

5. The method of claim 1, wherein the ignition component comprises a bridgewire.

6. The method of claim 1, wherein the igniter comprises boron-potassium nitride.

7. The method of claim 1, wherein the body comprises a first body and the ignition component comprises a first ignition component, wherein the tool comprises a first module comprising the first body and the first ignition component, wherein the tool further comprises:

a second body defining a second interior chamber, the second interior chamber containing a second plurality of reactants, the second plurality of reactants comprising sodium azide;

a second ignition component configured connected to the wireline, the second ignition component comprising a second igniter.

8. The method of claim 7, wherein the first module and the second module are located at different depths in the wellbore.

9. The method of claim 8, comprising:

determining a depth in the wellbore for the in-situ production of nitrogen; and determining that the second module is nearest the depth.

* * * * *